US006515627B2

(12) United States Patent
Lopez et al.

(10) Patent No.: US 6,515,627 B2
(45) Date of Patent: Feb. 4, 2003

(54) MULTIPLE BAND ANTENNA HAVING ISOLATED FEEDS

(75) Inventors: Eduardo Lopez, Watsonville, CA (US); Thomas R. Trumbull, Redwood Estates, CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/783,623

(22) Filed: Feb. 14, 2001

(65) Prior Publication Data

US 2002/0163471 A1 Nov. 7, 2002

(51) Int. Cl.[7] ..... H01Q 1/38; H01Q 1/24
(52) U.S. Cl. ..... 343/700 MS; 343/702
(58) Field of Search ..... 343/700 MS, 702, 343/745, 749, 767, 846, 848

(56) References Cited

U.S. PATENT DOCUMENTS 5,861,854 A * 1/1999 Kawahata et al. ... 343/700 MS
5,959,582 A * 9/1999 Kawahata et al. ... 343/700 MS
6,040,806 A * 3/2000 Kushihi et al. ..... 343/700 MS
6,281,848 B1 * 8/2001 Nagumo et al. ..... 343/700 MS
6,300,909 B1 * 10/2001 Tsubaki et al. ..... 343/700 MS
6,323,811 B1 * 11/2001 Tsubaki et al. ..... 343/700 MS
6,384,786 B2 * 5/2002 Ito et al. ..... 343/700 MS
6,448,932 B1 * 9/2002 Stoilijkovic et al. . 343/700 MS
6,452,548 B2 * 9/2002 Nagumo et al. ..... 343/700 MS

* cited by examiner

*Primary Examiner*—Tan Ho
(74) *Attorney, Agent, or Firm*—Fulbright & Jaworski L.L.P.

(57) ABSTRACT

The invention discloses a slot antenna having a pair of orthogonally oriented front and rear reflector panels. In one embodiment, the antenna assembly includes first and second front panels oriented approximately orthogonally to each other, said first and second front panels being coupled together and having a substantially elongate slot defined upon at least a portion of each of the first and second front panels, and first and second rear reflector panels oriented approximately orthogonally to each other, and disposed proximate the first and second front panels, and a feed terminal coupled to one of the first or second front panels, said feed terminal being coupled to an input/output RF connection point. The slot antenna according to the present invention may be disposed within an associated wireless communications device relative to a ground plane element of a printed wiring board, or may be disposed separately away from the associated wireless communications device.

20 Claims, 6 Drawing Sheets

MULTIPLE BAND ANTENNA HAVING ISOLATED FEEDS

FIELD OF THE INVENTION

The present invention relates generally to antenna assemblies for wireless communication devices and systems, and in particular to multiple band antenna assemblies. The invention provides particular utility to multiple polarization antennas for with telecommunications devices, or other wireless devices.

BACKGROUND OF THE INVENTION

There is a need for a multiple band, isolated feed antenna assembly for efficient operation over a variety of frequency ranges. A further need exists for such an antenna to be suitable for mounting within a communication device and yet have little or no operational interference from other internal components of the device. In addition, there is a need for such antennas to provide polarization diversity, useful for reducing the effects of multipath.

Existing antenna structures for wireless devices include both external and internal structures. External single or multi-band wire dipole antennas are half wave antennas operating over one or more frequency ranges. The typical gain is +2 dBi. These antennas have no front to back ratio and therefore radiate equally toward and away from the user of the wireless device without Specific Absorption Rate (SAR) reduction. LC (inductor and capacitor) traps may be used to achieve multi-band resonances. The bandwidth near the head is limited to 80 degrees nominal.

Another external antenna structure is a single or multi-band asymmetric wire dipole. This antenna is a quarter wave antenna operating over one or more frequency ranges. The typical gain is +2 dBi. There is no front to back ratio or SAR reduction. LC traps may be used to achieve multi-band resonances. An additional quarter wave conductor is needed to achieve additional resonances. The beamwidth near the head is limited to 80 degrees nominal.

Internal single or multi-band antennas include asymmetric dipole antennas. These antennas include quarter wave resonant conductor traces, which may be located on a planar, printed circuit board. These antennas operate over one or more frequency ranges with a typical gain of +1 to +2 dBi, and have a slight front to back ratio and reduced SAR. These antenna structures may have one or more feedpoints, and require a second conductor for a second band resonance.

Another internal antenna structure is a single or multi-band planar inverted F antenna, or PIFA. These are planar conductors that may be formed by metallized plastics. PIFA operate over a second conductor or a ground plane. The typical gain for such antennas is +1.5 dBi. The front to back ratio and SAR values are dependent of frequency.

Yet other known antenna structures include quadrifilar helix and turnstile antenna structures providing circular polarization.

SUMMARY OF THE INVENTION

A multiple band antenna for internal installation in wireless communications devices is described. The antenna includes a plurality of feed points, one each for an associated transmission and reception band. Importantly, the antenna provides enhanced isolation between the plurality of feed points. Additionally, the antenna assembly may be incorporated within such devices with minimal operational interference.

Another object of the invention is to provide an antenna integrated upon a transceiver board for ease and economy of manufacture. The antenna assembly is of a compact size suitable for mounting directly on the printed wiring board of a wireless communications device. The antenna is preferably positioned at an upper rear side of the device.

The antenna assembly of the present invention also preferably provides a dual band antenna for wireless communications devices having separated feeds for each band and isolation between feed points in the range of 10–24 dB.

Other objects and advantages include the provision of: a dual band antenna that exhibits elliptical polarization in at least one of the bands; a relatively high bandwidth; and amenability to efficient mass production processes.

In one embodiment, the antenna assembly may be disposed away from the ground plane of an associated wireless communications device and coupled via a pair of signal transmission lines such as RF coax lines, microstrip transmission lines, coplanar wave guides, or other known signal transmission approaches as appreciated by those skilled in the arts.

DETAILED DESCRIPTION OF THE PREFERRED EMBODIMENTS

Figure 1:
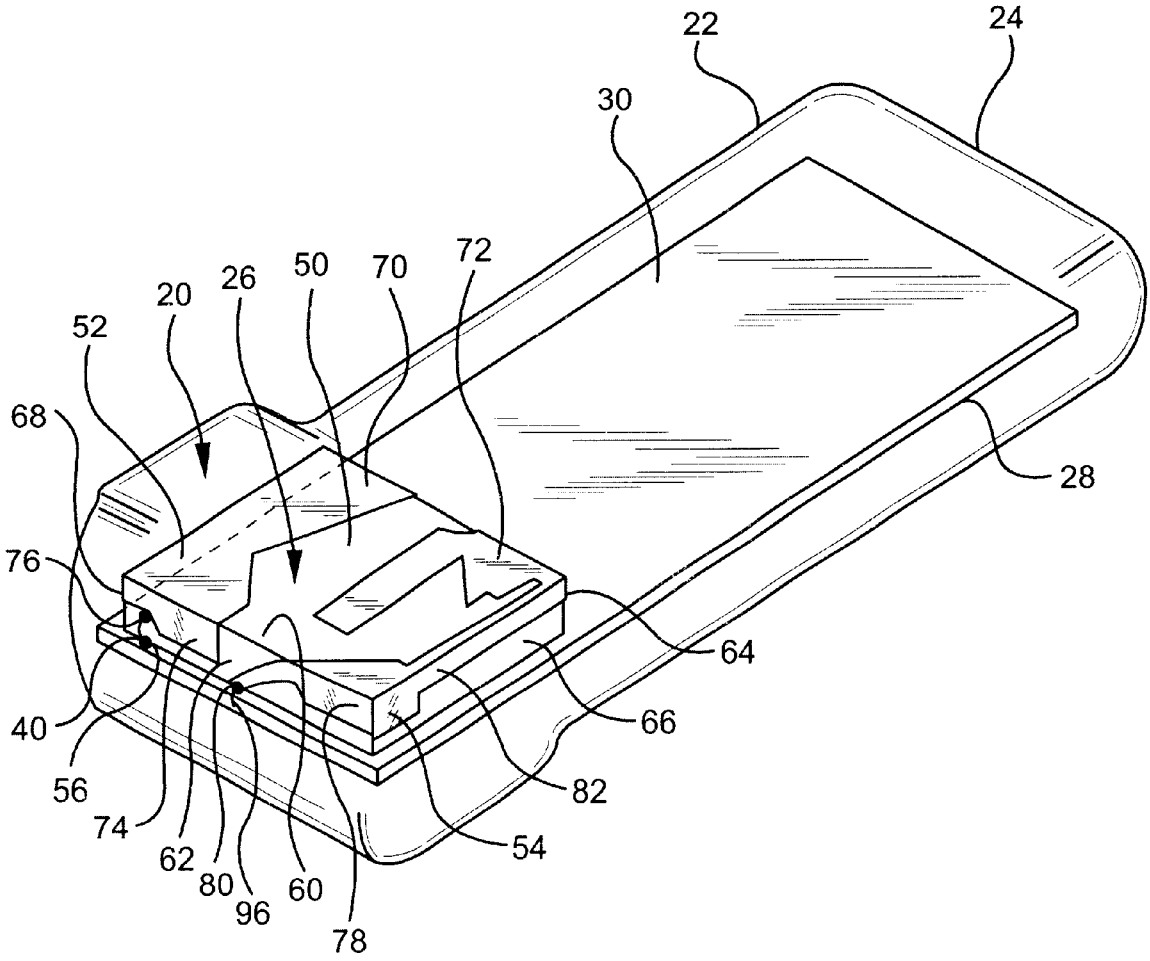
FIG. 1 is a perspective view of a wireless communications device incorporating an antenna assembly according to the present invention.
Figure 2:
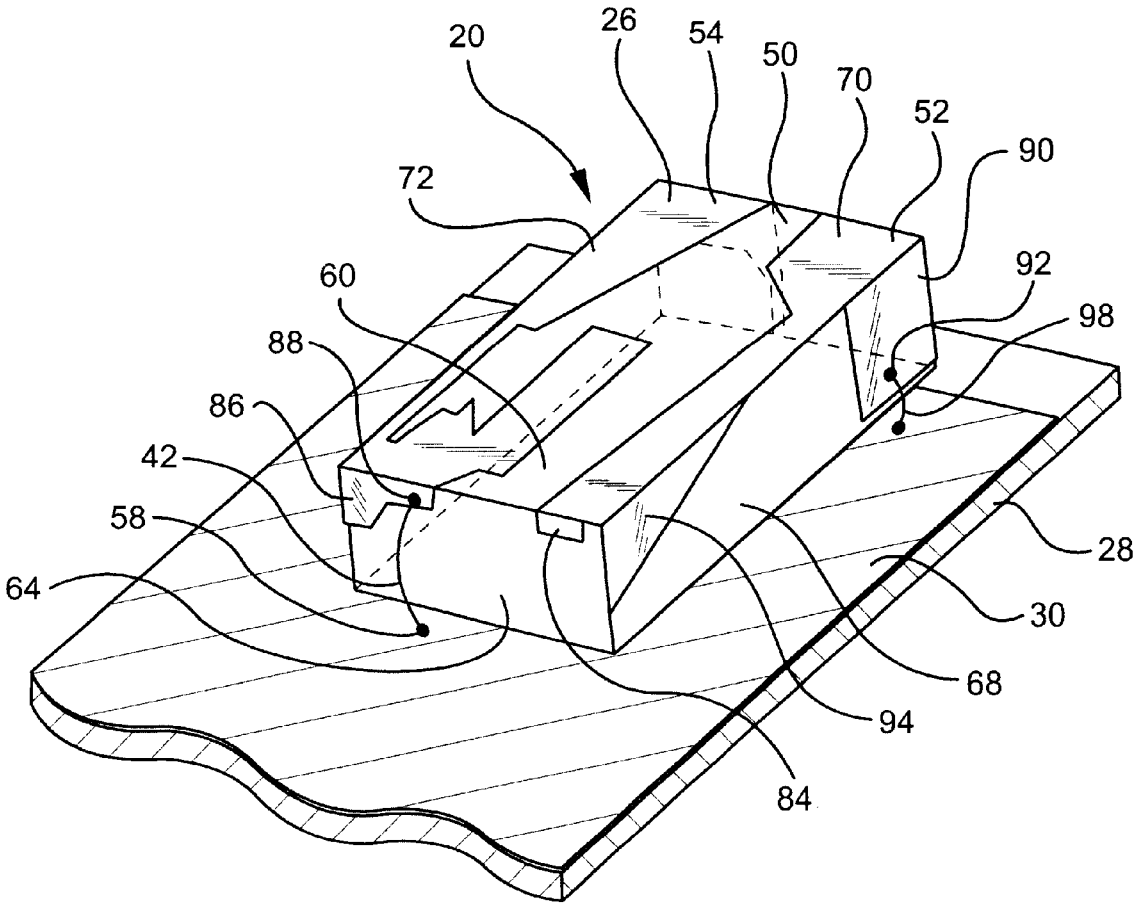
FIG. 2 is a detailed perspective view of the antenna assembly of FIG. 1.
Figure 3A:
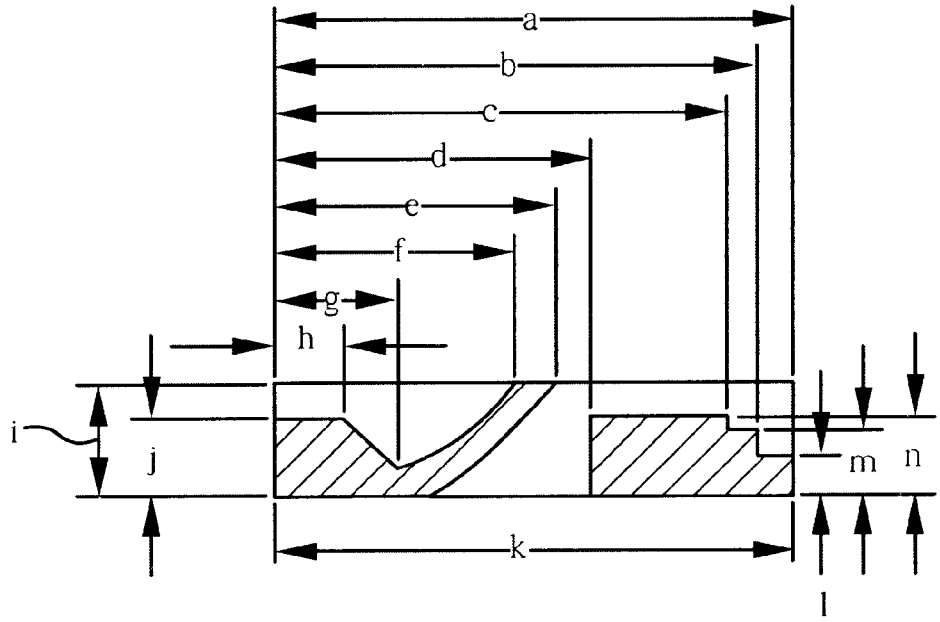
FIG. 3 illustrates various view of the antenna assembly of FIGS. 1 and 2.
Figure 3B:
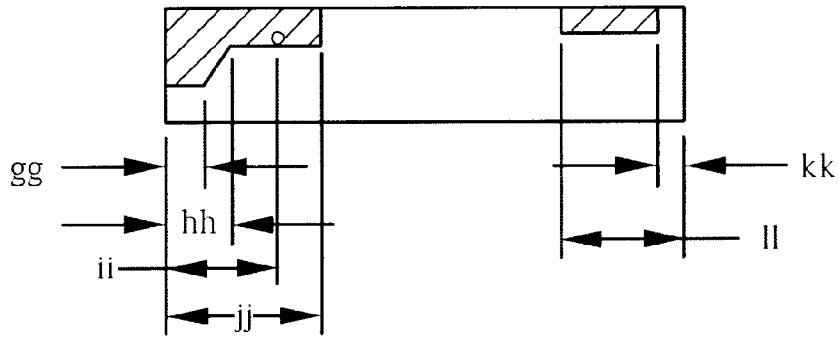
Figure 3C:
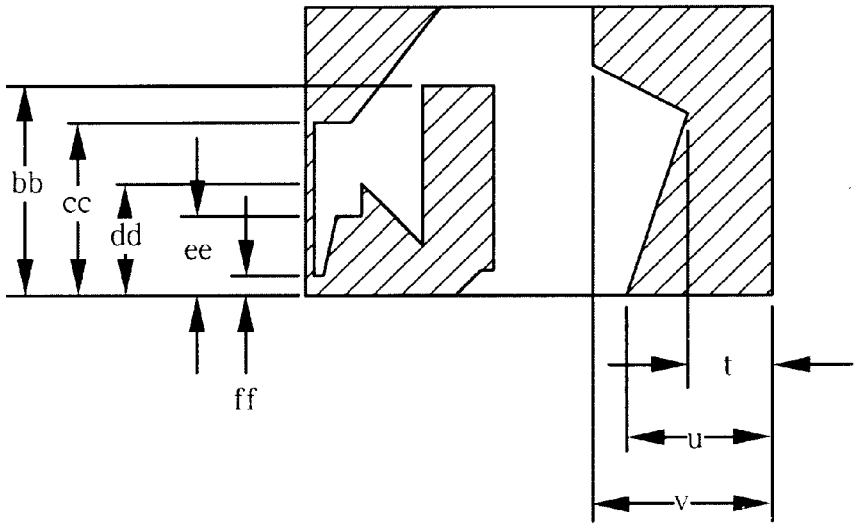
Figure 3D:
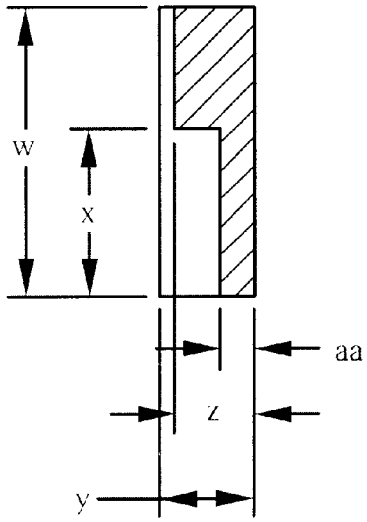
Figure 3E:
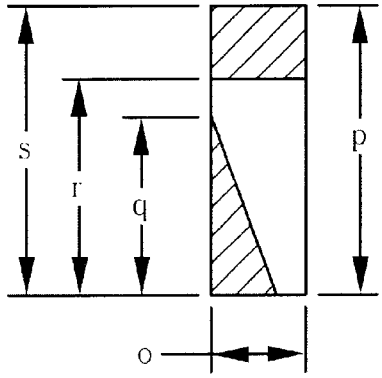

Referring now to the drawings, wherein like numerals depict like parts throughout, FIGS. 1 and 2 illustrate an antenna assembly 20 according to the present invention disposed near the upper rear portion of a hand-held wireless communications device 22. The antenna 20 is disposed within the housing 24 of the wireless communications device 22. The antenna assembly 20 according to the present invention includes a resonator structure 26 disposed relative to a ground plane 28 of the wireless communications device 22. As depicted, the resonator structure 26 of the antenna assembly 20 is disposed at an upper end portion of a printed wiring board (PWB) 30 and is operatively coupled to the PWB 30 by a pair of signal feed elements 40, 42, including a high frequency feed element 40 and a lower frequency feed element 42. The resonator structure 26 is illustrated as conductive sections disposed upon a dielectric substrate element 50. Alternatively, the resonator structure 26 may be formed from bent metal elements or plated plastic components (not shown).

The resonator structure 26 includes a high frequency resonator 52 and a low frequency resonator 54, each separately coupled to the ground plane 28 and respective input/output ports 56, 58 on the printed wiring board 30, and each sized to resonate at the respective frequency bands.

Referring to FIGS. 1 and 2, the resonator structure 26 includes an upper face surface 60, a top surface 62, a bottom surface 64 and left and right surfaces 66, 68. The upper face surface 60, top surface 62, and bottom surface 64, each include portions of both high and low frequency resonator elements 52, 54. The left surface 66 includes a portion 82 of the low frequency resonator element 54. The right surface 68 includes portions 92, 94 of the high frequency resonator surface 52.

The upper face surface 60 includes portions 70, 72 of both the high and low frequency resonator elements 52, 54. The portion 70 of the high frequency resonator element 52 extends to the top, bottom, and right surfaces 62, 64, 68. The portion 72 of the low frequency resonator element 54 extends between the top, bottom, and left surfaces 62, 64, 66.

As shown in FIG. 1, the top surface 62 of the resonator includes a portion 74 of the high frequency resonator element 52 defining a high frequency feed point 76. The high frequency feed point 76 is coupled via the high frequency feed element 40 to the high frequency input/output RF port 56 of the PWB 30. The portion 74 extends between the upper face surface 60 and the right surface 68. The top surface 62 further includes a portion 78 of the low frequency resonator element 54 defining a ground connection point 80. As described in more detail hereinafter, the ground connection point 80 is coupled to the ground plane 28 of the PWB 30 via a low frequency grounding element 96. The portion 78 extends between the upper face surface 60 and the left surface 66.

As further shown in FIGS. 1 and 2, the left surface 66 of the resonator 26 includes a portion 82 of the low frequency resonator element 54. The portion 82 extends between the upper face surface 60, the top surface, 62 and the bottom surface 64. The portion 82 is coupled to portions 72, 78, and 86.

As shown in FIG. 2, the bottom surface 64 of the resonator includes a portion 84 of the high frequency resonator element 52. The portion 84 extends to the upper face surface 60 and is coupled with portion 70. The bottom surface further 64 includes a portion 86 of the low frequency resonator element 54 defining a low frequency feed point 88. The low frequency feed point 88 is coupled to the low frequency input/output RF port 58 via the low frequency feed element 42. The portion 86 extends between the upper face surface 60 and the left surface 66 and is coupled to portions 72 and 82.

As further shown in FIGS. 1 and 2, the right surface 68 of the resonator includes a portion 90 of the high frequency resonator element 52 defining a high frequency ground connection point 92. As described in more detail hereinafter, the high frequency ground connection point 92 is coupled to the ground plane 28 of the PWB 30 via a high frequency grounding element 98. The portion 90 extends between the upper face surface 60 and the top surface 62 and is coupled to portions 70 and 74. The right surface 68 further includes a portion 94 of the high frequency resonator element 52 which extends to the upper face surface 60 and surface 64 and is coupled to portion 70.

Referring to FIG. 1, high frequency feed element 40 includes a first end which is operatively connected to the resonator structure 26 at feed point 76, or portion 74 and a second end which is operatively connected to the PWB 30 at a high frequency RF 50 ohm input/output terminal or port 90.

Referring to FIG. 2, low frequency feed element 42 includes a first end which is operatively connected to the resonator structure 26 at feed point 88 on portion 86, and a second end which is operatively connected to the PWB 30 at a low frequency RF 50 ohm input/output terminal or port 92.

High frequency grounding element 98 has two ends, one end of which is operatively coupled to portion 90 of the high frequency resonator element 52. The other end of the high frequency grounding element 96 is operatively connected near the top of the PWB 30 to the ground plane 28 in a conventional manner. Low frequency grounding element 96 has two ends, one end of which is operatively coupled to portion 78 of the resonator element 54. The other end of the low frequency grounding element 96 is operatively connected near the top of the PWB 30 to the ground plane 28 in a conventional manner.

The antenna assemblies 20 of FIGS. 1 and 2 are sized to function over two different frequency bands, such as 880–960 MHz and 1710–1880 MHz or 824–894 MHz and 1850–1990 MHz. FIG. 3 illustrates views of the resonator element 26 of the antenna assembly 20 of the present invention. Dimensions of the features of the components indicated in FIG. 3 are as follows:

| Item | Dimension (in.) |
|---|---|
| a | 1.47 |
| b | 1.34 |
| c | 1.24 |
| d | .792 |
| e | .774 |
| f | .655 |
| g | .363 |
| h | .278 |
| i | .276 |
| j | .148 |
| k | 1.47 |
| l | .159 |
| m | .250 |
| n | .281 |
| o | .315 |
| p | .79 |
| q | .459 |
| r | .558 |
| s | .79 |
| t | .315 |
| u | .505 |
| v | .666 |
| w | .79 |
| x | .437 |
| y | .315 |
| z | .299 |
| aa | .126 |
| bb | .588 |
| cc | .427 |
| dd | .280 |
| ee | .208 |
| ff | .078 |
| gg | .227 |
| hh | .240 |
| ii | .355 |
| jj | .576 |
| kk | .248 |
| ll | .446 |

Figure 4:
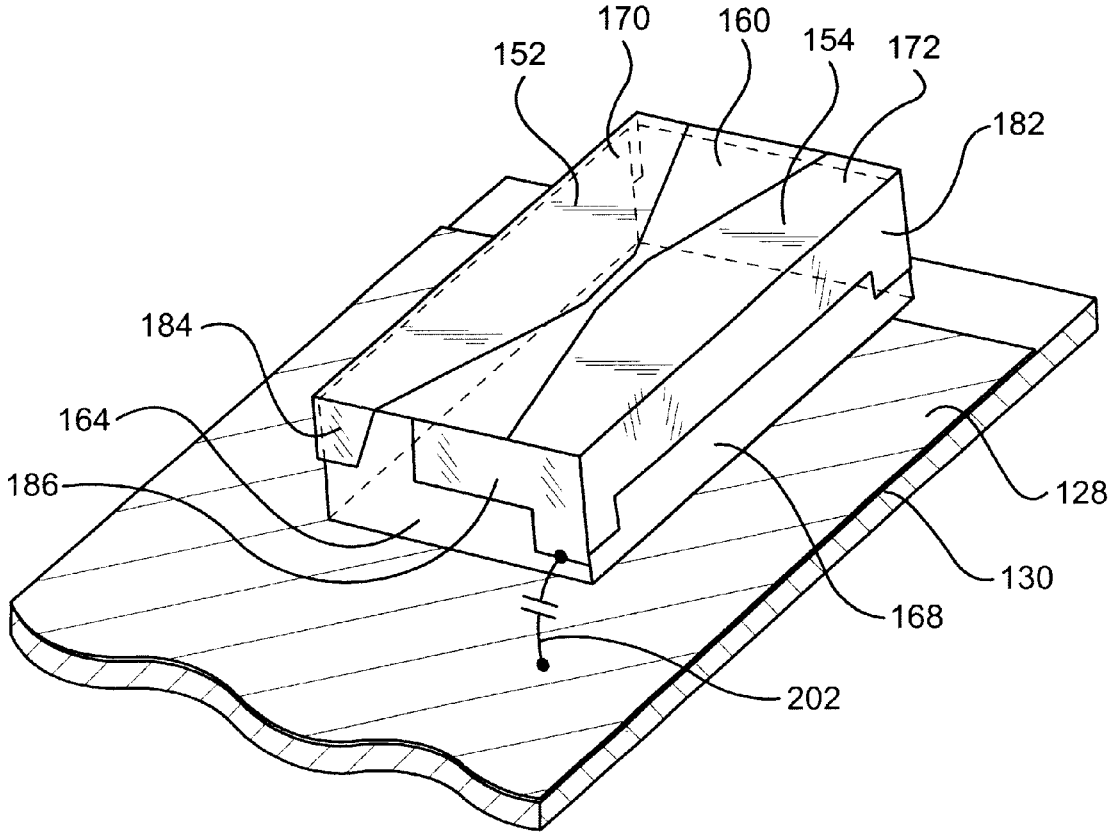
FIG. 4 is a perspective view of a wireless communications device incorporating another embodiment of an antenna assembly according to the present invention.
Figure 5:
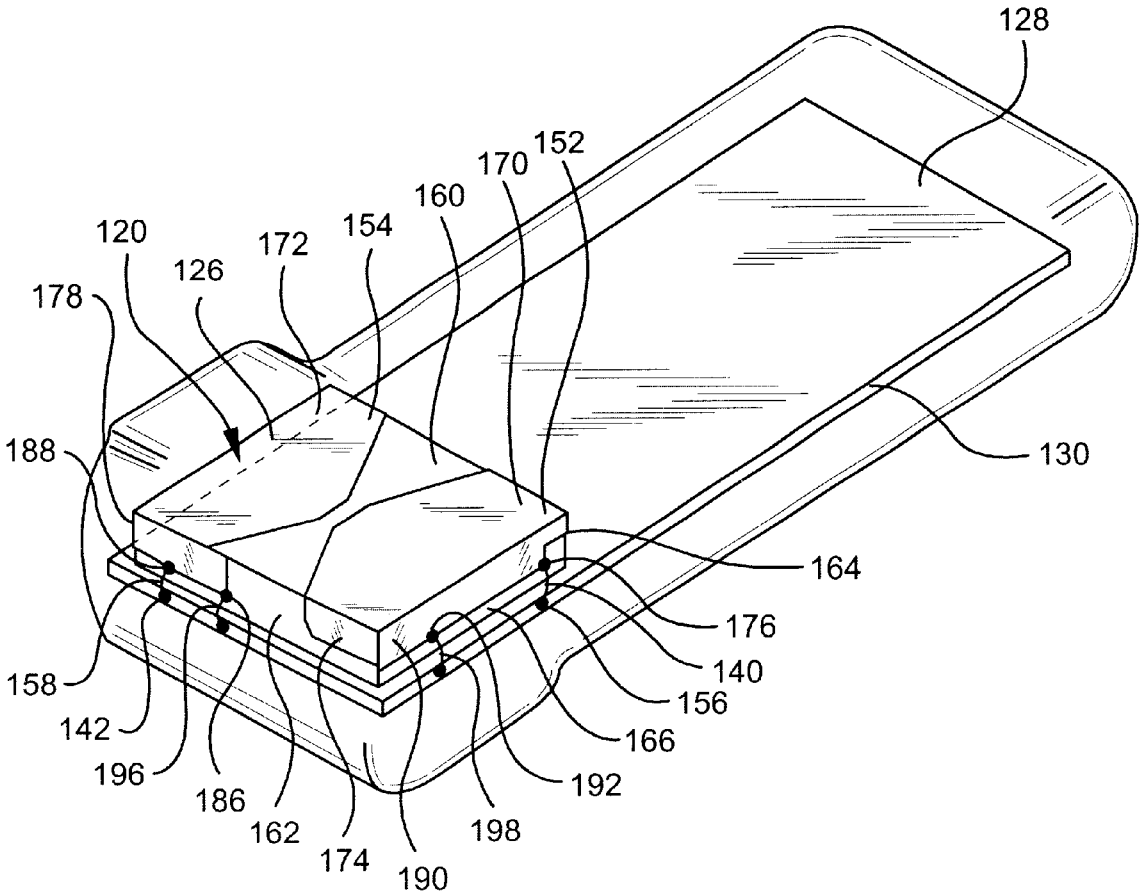
FIG. 5 is a detailed perspective view of the antenna assembly of FIG. 4.

FIGS. 4 and 5 illustrate another embodiment of the antenna assembly 120 according to the present invention. The resonator structure 126 includes a high frequency resonator 152 and a low frequency resonator 154, each separately coupled to the ground plane 128 and respective input/output ports 156, 158 on the printed wiring board 130, and each sized to resonate at the respective frequency bands.

The resonator structure 126 includes an upper face surface 160, a top surface 162, a bottom surface 164, and left and right surfaces 166, 168. The upper face surface 160, top surface 162, and bottom surface 164, each include portions of both high and low frequency resonator elements 152, 154. The left surface 166 includes a portion 190 of the high frequency resonator element 152. The right surface 168 includes a portion 182 of the low frequency resonator surface 154.

The upper face surface 160 includes portions of 170, 172 both the high and low frequency resonator elements 152, 154. The portion 170 of the high frequency resonator element 152 extends to the top, bottom, and left surfaces 162, 164, 166. The portion 170 is coupled to portions 174, 184, 190. The portion 172 of the low frequency resonator element 154 extends between the top, bottom, and right surfaces 162, 164, 168. The portion 172 is coupled to portions 178, 182, 186.

As shown in FIG. 4, the left surface 166 of the resonator includes a portion 190 of the high frequency resonator element 152 defining the high frequency feed point 176. The high frequency feed point 176 is coupled via the high frequency feed element 140 to the high frequency input/output RF port 156 of the PWB 130. The portion 190 of the high frequency resonator element 154 further defines a ground connection point 192. As described in more detail hereinafter, the ground connection point 192 is coupled to the ground plane 128 of the PWB 130 via a high frequency grounding element 198.

As further shown in FIGS. 4 and 5, the right surface 168 of the resonator 126 includes a portion 182 of the low frequency resonator element 154. The portion 182 extends between the upper face surface 160, the top surface 162, and the bottom surface 164. The portion 182 is coupled to portions 172, 178, and 186.

As shown in FIG. 5, the bottom surface 164 of the resonator includes a portion 184 of the high frequency resonator element 152. The portion 184 extends to the upper face surface 160 and left surface 166, and is coupled to portions 170 and 190. The bottom 164 further includes a portion 186 of the low frequency resonator element 154. The portion 186 extends between the upper face surface 160 and the right surface 166 and is coupled to portions 172 and 182. A tuning capacitor 202 may be coupled between the conductive portion 186 and the ground plane circuit 130.

The top surface 162 of the resonator includes a portion 178 of the low frequency resonator element 154 defining a low frequency ground connection point 180. As described in more detail hereinafter, the low frequency ground connection point 180 is coupled to the ground plane 128 of the PWB 130 via a low frequency grounding element 196. The portion 178 extends between the upper face surface 160 and the right surface 168 and is coupled to portions 172 and 182. The portion 178 further defines a low frequency feed point 178. A low frequency feed element 142 includes a first end which is operatively connected to the resonator structure 126 at feed point 178, and a second end which is operatively connected to the PWB 130 at a low frequency RF 150 ohm input/output port 158.

High frequency feed element 140 includes a first end which is operatively connected to the resonator structure 126 at feed point 176 on portion 174 and a second end which is operatively connected to the PWB 130 at a high frequency RF 150 ohm input/output terminal or port 156.

The resonator structure 126 includes high and low frequency grounding points 192, 180, and high and low frequency grounding elements 198, 196. High frequency grounding element 198 has two ends, one end of which is operatively coupled to portion 190 of the high frequency resonator element 152. The other end of the high frequency grounding element 198 is operatively connected near the top of the PWB 130 to the ground plane 128 in a conventional manner. Low frequency grounding element 196 has two ends, one end of which is operatively coupled at ground point 180. The other end of the low frequency grounding element 196 is operatively connected near the top of the PWB 130 to the ground plane 128 in a conventional manner.

The view of FIGS. 1, 2, 4, and 5 are not necessarily to scale, but illustrate possible orientations and components of a wireless communications device including an antenna assembly according to the present invention.

It should be noted that the drawings may indicate proportions and dimensions of components of the antenna device. However, e.g., thickness of conductive layers have been exaggerated for clarity. Although, in many embodiments conductive layers have been mentioned, it is understood that it includes the use of conductive plates, foils, etc., possibly attached, secured, or otherwise disposed upon dielectric substrate(s).

With knowledge of the present disclosure, other modifications will be apparent to those persons skilled in the art. Such modifications may involve other features which are already known in the design, manufacture and use of antennas and component parts thereof and which may be used instead of or in addition to features already described herein. Such modifications may include alternative manufacturing processes to form the various antenna portions, e.g., for example, conductive material selectively plated over dielectric substrate or dielectric materials, and plated plastic components and conductive foil elements. In an alternative, the antenna assembly 120 may be operatively coupled to the PWB 30, 130 via a coaxial RF cable, a strip line feed, a ground portion of a coplanar wave guide, or other methods as known to those skilled in the relevant arts. Additionally, while the preferred embodiments have been described herein as applying to the wireless local area network frequencies, operation in alternative bandwidths may also be feasible. Those skilled in the relevant arts will appreciate the applicability of the antenna assembly of the present invention to alternative bandwidths by proper scaling of the antenna components, etc. Still other changes may be made without departing from the spirit and scope of the present invention.

We claim:

1. An antenna assembly for a multiple-band wireless communications device, comprising:

a circuit board element defining at least a ground plane and a pair of input/output RF connection points; and first and second resonator structures, each of the resonator structures including a plurality of orthogonal conductive elements, each of the resonator structures being connected to the ground plane and to one of the pair of RF connection points, and each of the resonator structures including at least one conductive corner structure wherein three of the orthogonal conductive elements are coupled together.

2. The antenna assembly of claim 1 wherein the first and second resonator structures are disposed upon a dielectric substrate element.

3. The antenna assembly of claim 2 wherein the dielectric substrate element is substantially rectangular.

4. The antenna assembly of claim 2 wherein the dielectric element includes plated portions and the resonator structures are the plated portions of the dielectric substrate element.

5. The antenna assembly of claim 1 wherein the first and second resonator structures are formed from bent conductive material.

6. The antenna assembly of claim 5, further comprising:

a tuning capacitor element operatively coupling one of the resonator structures to the ground plane of the wireless communications device.

7. The antenna assembly of claim 1, wherein each of the resonator structures are coupled to the ground plane and to one of the pair of RF connection points on different ones of the plurality of orthogonal conductive elements.

8. An antenna assembly for a multiple-band wireless communications device, comprising:

a board element defining at least a ground plane and a pair of input/output RF connection points; and first and second resonator structures disposed in side by side relation a predetermined distance away from the ground plane, each of the resonator structures including a plurality of orthogonal conductive elements, each of the resonator structures including at least one conductive corner structure wherein three of the orthogonal conductive elements are coupled together, and each of the resonator structures being connected to the ground plane and to one of the pair of RF connection points.

9. The antenna assembly of claim 8 wherein the first and second resonator structures are disposed upon a dielectric substrate element.

10. The antenna assembly of claim 9 wherein the dielectric substrate element is substantially rectangular.

11. The antenna assembly of claim 9 wherein the dielectric element includes plated portions and the resonator structures are the plated portions of the dielectric substrate element.

12. The antenna assembly of claim 8 wherein the first and second resonator structures are formed from bent conductive material.

13. The antenna assembly of claim 8, wherein each of the resonator structures are coupled to the ground plane and to one of the pair of RF connection points on different ones of the plurality of orthogonal conductive elements.

14. The antenna assembly of claim 8, further comprising:

a tuning capacitor element operatively coupling one of the resonator structures to the ground plane of the wireless communications device.

15. An antenna element for a wireless communications device having a circuit board element defining a pair of input/output RF connection points and a pair of ground connection points, said antenna element comprising:

a pair of resonator structures, each of the pair of resonator structures being connected to one of the ground connection points and to one of the RF connection points, wherein each of the pair of resonator structures includes a top surface portion and a plurality of substantially orthogonal side portions coupled to top surface portion, and wherein each of the pair of resonator structures defines at least one conductive corner structure defined by three of the side portions which are coupled together.

16. The antenna element of claim 15 wherein the pair of resonator structures are disposed upon a dielectric substrate element.

17. The antenna element of claim 16 wherein the dielectric substrate element is substantially rectangular.

18. The antenna element of claim 15 wherein the dielectric element includes plated portions and the resonator structures are the plated portions of the dielectric substrate element.

19. The antenna element of claim 15 wherein the pair of resonator structures are formed from bent conductive material.

20. The antenna element of claim 15 further comprising:

a tuning capacitor element operatively coupling one of the resonator structures to the ground plane of the wireless communications device.

* * * * *